US011149417B2

(12) United States Patent
Wu et al.

(10) Patent No.: US 11,149,417 B2
(45) Date of Patent: Oct. 19, 2021

(54) SHOWER HEAD FIXTURE

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Peng-Wei Xie, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 4 days.

(21) Appl. No.: 16/727,195

(22) Filed: Dec. 26, 2019

(65) Prior Publication Data

US 2021/0198877 A1 Jul. 1, 2021

(51) Int. Cl.

| | |
|---|---|
| ***E03C 1/04*** | (2006.01) |
| *B05B 1/18* | (2006.01) |
| *A47K 3/28* | (2006.01) |

(52) U.S. Cl.
CPC ..... *E03C 1/0408* (2013.01); *A47K 3/281* (2013.01); *B05B 1/18* (2013.01)

(58) Field of Classification Search
CPC ..... E03C 1/0408; A47K 3/281; B05B 1/18; B05B 1/185
USPC ..... 4/570
See application file for complete search history.

(56) References Cited

U.S. PATENT DOCUMENTS

| | | | | |
|---|---|---|---|---|
| 2009/0007330 | A1* | 1/2009 | Genord | B05B 15/62 4/695 |
| 2017/0014849 | A1* | 1/2017 | Gao | B05B 15/62 |
| 2017/0173603 | A1* | 6/2017 | Lin | B05B 1/1681 |
| 2018/0104707 | A1* | 4/2018 | Lin | E03C 1/06 |
| 2018/0193851 | A1* | 7/2018 | L'Henaff | B05B 15/62 |
| 2019/0299224 | A1* | 10/2019 | Wu | E03C 1/06 |
| 2019/0323214 | A1* | 10/2019 | Wang | B05B 1/185 |
| 2020/0122166 | A1* | 4/2020 | Farley | E03C 1/0409 |

* cited by examiner

*Primary Examiner* — Huyen D Le
(74) *Attorney, Agent, or Firm* — Birch, Stewart, Kolasch & Birch, LLP

(57) ABSTRACT

A shower head fixture is provided, which relates generally to bath installations and includes a fixing assembly and a shower assembly. The fixing assembly includes a global head seat and a fixing holder, wherein the global head seat is movably provided on the fixing holder through a global head connection mechanism. The global head seat has an embedded portion; the shower assembly has a clasp portion which is fastened to the embedded portion. The shower head fixture can not only be quickly fixed and detached, but be adjusted up and down according to the required height of users.

10 Claims, 8 Drawing Sheets

SHOWER HEAD FIXTURE

BACKGROUND OF THE INVENTION

1. Technical Field

The present invention relates generally to bath installations, and more particularly to a shower head fixture.

2. Description of Related Art

Shower head is also called shower nozzle, and is originally a tool for watering flowers, potted plants, and other plants. Afterward, some people refitted it in a shower device, making it a common installation in the bathroom. Presently, there are many types of shower heads which are mostly designed as mobile shower heads so as to facilitate the shower. For installing the current mobile shower heads, a seat fixed on the wall is used for being inserted by a handle of the shower head, so that users can easily take the shower head off the seat, or fix the shower head back to the seat. However, by the connection with the abovementioned seat and handle, the shower head can only be adjusted leftward or rightward, that is, the adjustment angle is small and cannot meet the requirements of all consumers.

BRIEF SUMMARY OF THE INVENTION

In view of the above, the primary objective of the present invention is to provide a shower head fixture. The shower head fixture can make the shower head be fixed quickly and be adjusted up and down according to the required height of users.

The present invention provides a shower head fixture including a fixing assembly and a shower assembly. The fixing assembly includes a global head seat and a fixing holder, wherein the global head seat is movably provided on the fixing holder through a global head connection mechanism. The global head seat has an embedded portion; the shower assembly has a clasp portion which is fastened to the embedded portion.

Furthermore, the global head connection mechanism includes a global head, a locking chamber, a locking member, and a friction member. The global head is provided on the global head seat; the locking chamber is provided in the fixing holder; the global head is movably provided in the locking chamber; the locking member and the friction member are both provided in the locking chamber; the global head is tightly locked by the locking member, which prevents the global head from falling off the locking chamber; the global head and friction member coordinate closely with friction.

Furthermore, the clasp portion is a semicircular clasp structure, and an insertion opening is provided at a bottom of the clasp portion; the embedded portion is a circular plate structure and is corresponding to the clasp portion; the embedded portion is inserted through the insertion opening to be embedded and clasped in the clasp portion.

Furthermore, the clasp portion is provided on a back of the shower assembly.

Furthermore, the magnetic structure is provided between the fixing assembly and the shower assembly to magnetically fix the fixing assembly and the shower assembly.

Furthermore, the magnetic structure includes a magnetic tablet and a metal tablet which is magnetically attracted to the magnetic tablet, or two magnets magnetically attracted to each other. The fixing assembly includes the metal tablet, the magnetic tablet, or the magnet, while the shower assembly is provided corresponding to the fixing assembly.

Furthermore, the magnetic tablet is fixed on a side of the global head seat of the fixing assembly, which is close to the shower assembly; while the metal tablet is fixed on a side of the shower assembly, which is close to the global head seat.

Furthermore, a top spray support is installed on a wall, wherein the top spray support includes a water catching pipe inside. The fixing holder is fixed on the wall or on the top spray support.

Furthermore, the fixing holder has a communicating hole therein, wherein the communicating hole has a first opening and a second opening. The first opening is positioned at a junction of the fixing holder and an end of the top spray support, and communicates with the water catching pipe of the top spray support, and the communicating hole hermetically connected to the water catching pipe. The second opening is positioned at a junction of the fixing holder and a hose of the shower assembly, and the communicating hole is hermetically connected to the hose. The water sequentially enters the top spray support, the communicating hole, the hose, and finally the shower assembly.

The effects of the present invention are as follows.

1. The embedded portion and the clasp portion provided between the fixing assembly and the shower assembly facilitate the quickly fixation and the detachment of the shower head.

2. Through the global head connection mechanism provided on the fixing assembly, the shower head can be adjusted in any direction for being used easily.

3. The fixing assembly and the shower assembly are fixed more stably through the magnetic structure provided between the two assemblies, which prevents them from falling off from each other.

4. The fixing holder can be fixed in various forms, including fixed on the wall directly or on the top spray support, which is flexible and convenient for a variety of situations.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
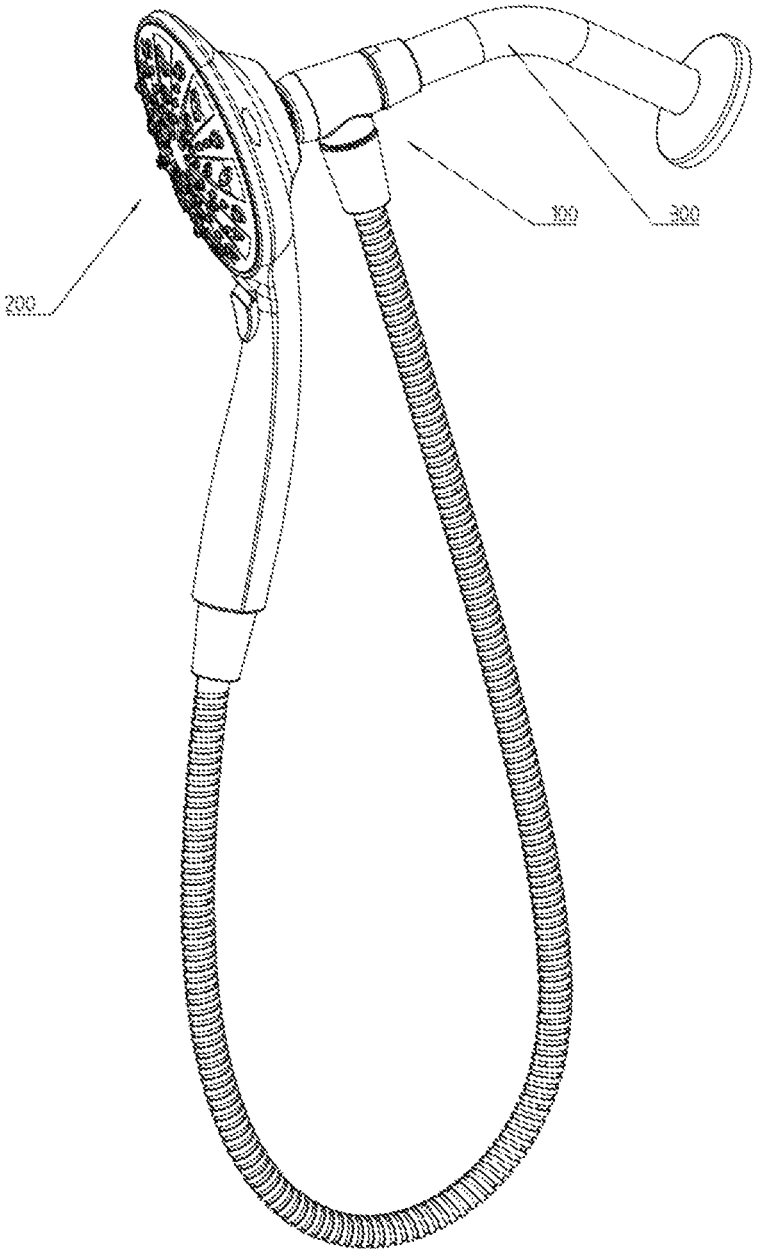
FIG. 1 is a perspective view of the shower head fixture of the first preferred embodiment of the present invention.

As shown in FIG. 1, the first preferred embodiment of the present invention, a shower head fixture, includes a fixing assembly 100 and a shower assembly 200. The fixing assembly 100 is fixed on the wall by a top spray support 300. The shower assembly 200 is then fixed on the fixing assembly 100 so as to fixedly install the shower head.

Figure 2:
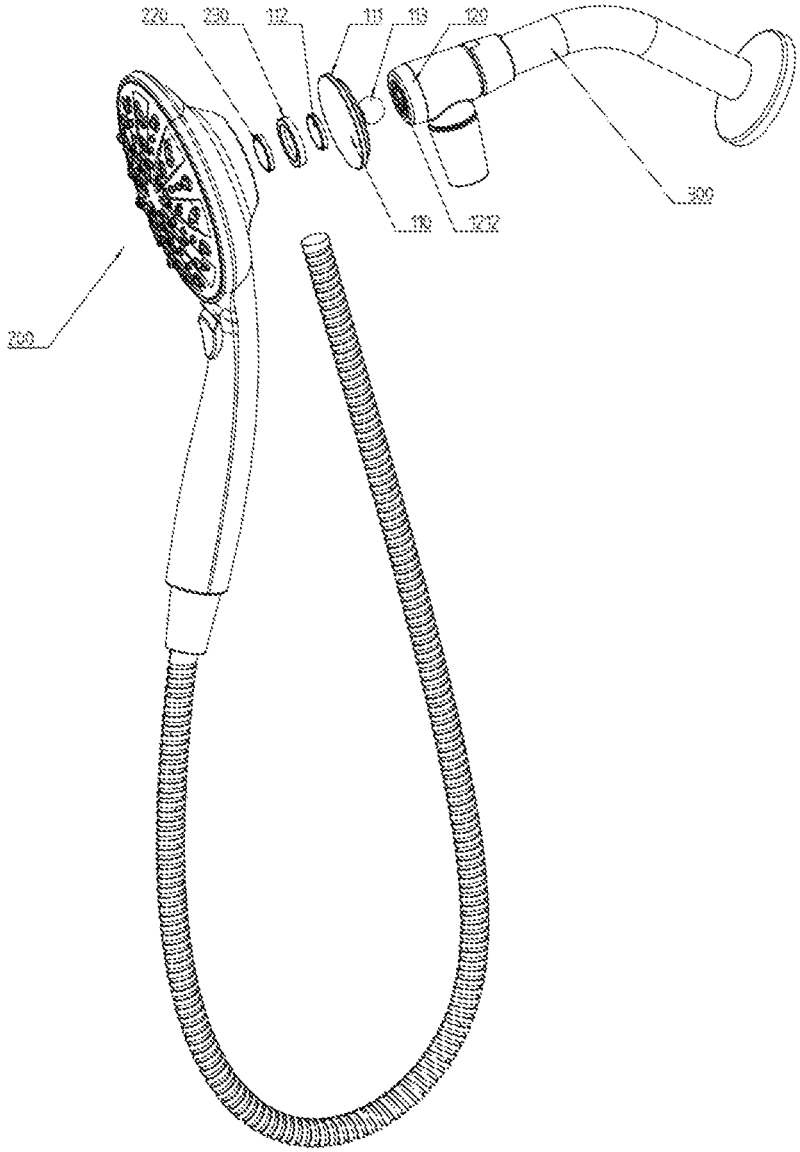
FIG. 2 is an exploded view of the shower head fixture in FIG. 1.
Figure 3:
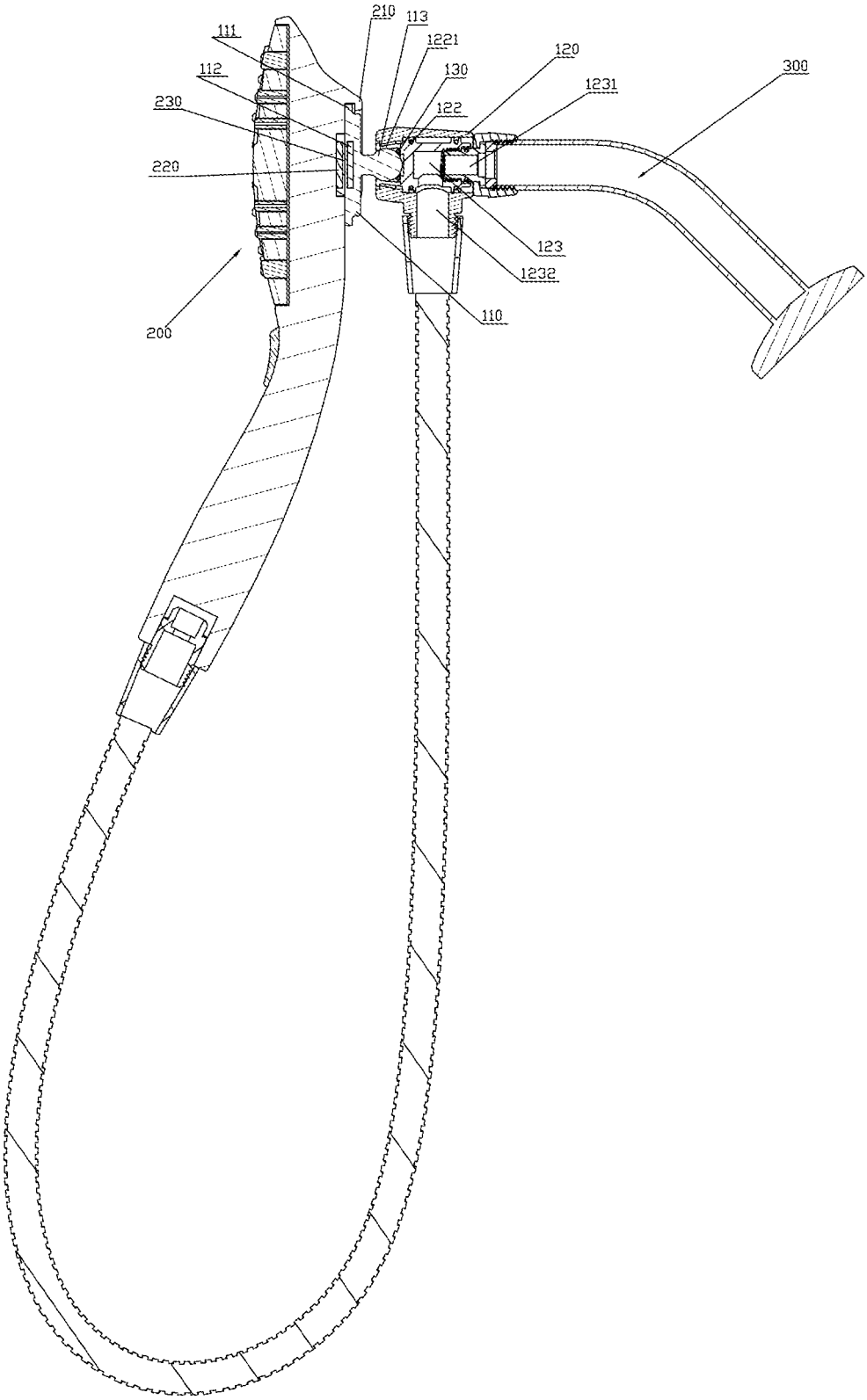
FIG. 3 is a sectional view of the shower head fixture in FIG. 1.

As illustrated in FIG. 2 and FIG. 3, the fixing assembly 100 includes a global head seat 110 and a fixing holder 120. The fixing holder 120 is fixed on the top spray support 300 to facilitate the installation of the fixing assembly 100 and the shower head. The global head seat 110 is movably installed on the fixing holder 120 through a global head connection mechanism, so that the tilt angle of the global head seat 110 can be adjusted so as to facilitate the adjustment of the shower head. The global head seat 110 has an embedded portion 111, while the shower assembly 200 has a clasp portion 210; the clasp portion 210 and the embedded portion 111 are fastened to each other so as to facilitate the installation of the shower head. After installation, the tilt angle of the shower head can be adjusted at users' own choices by moving the global head seat 110, which is convenient for users to take a shower.

Figure 4:
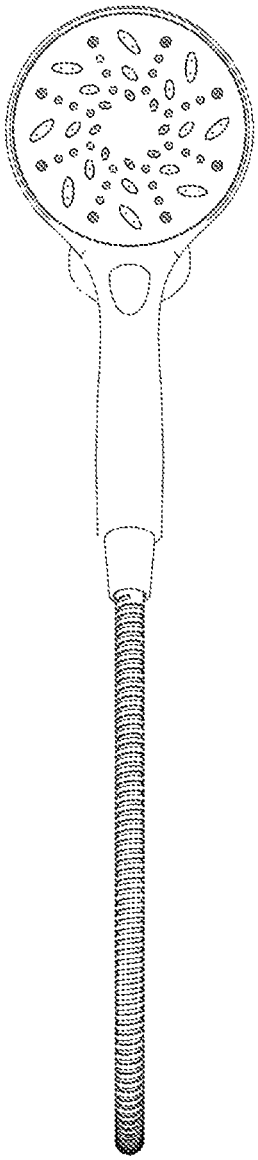
FIG. 4 is a front view of the shower head fixture in FIG. 1.
Figure 5:
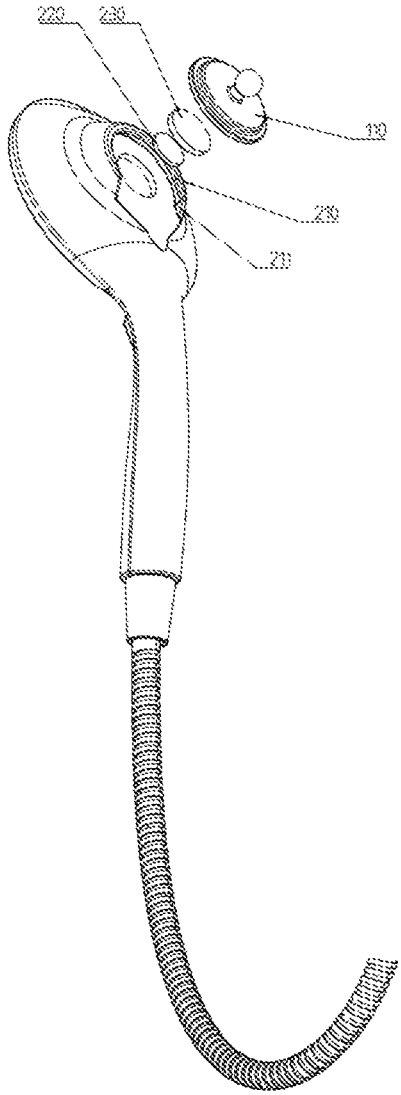
FIG. 5 is a schematic diagram of the embedded portion of the shower head fixture in FIG. 1.

Specifically, as shown in FIG. 3 to FIG. 5, the clasp portion 210 is a semicircular clasp structure, and an insertion opening 211 is provided at the bottom of the clasp portion 210. The embedded portion 111 is a circular plate structure and is corresponding to the clasp portion 210. The embedded portion 111 is embedded and clasped in the clasp portion 210 by inserting through the insertion opening 211. Therefore, its convenient to fasten and detach the shower assembly 200 and the fixing assembly 100, which performs the function of quick installation and easy detachment.

In this embodiment, as shown in FIG. 2 and FIG. 3, the global head connection mechanism includes a global head 113, a locking chamber 1212, a locking member 122, and a friction member 130. The global head 113 is movably provided in the locking chamber 1212; moreover, the locking member and the friction member are installed in the locking chamber. The locking member 122 has a claw 1221 which provided around and clips the global head 113, and tightly locks the global head 113, which prevents the global head 113 from falling off the locking chamber 1212. Additionally, the global head 113 and friction member 130 coordinate closely with friction, which keeps the global head 113 from freely rotating, and therefore facilitates the positioning of the adjusted global head seat 110 so as to improve the convenience in the tilt angle adjustment of the shower.

In this embodiment, as shown in FIG. 3 and FIG. 5, the clasp portion 210 is provides on the back of the shower assembly 200 to facilitate the fixation and the detachment of the shower head. Furthermore, a magnetic structure is provided between the fixing assembly 100 and the shower assembly 200 to magnetically fix the fixing assembly 100 and the shower assembly 200. Accordingly, the stability of the fixed shower head would be improved; in addition, it would be easy and quick to detach the shower head with just a little force.

In this embodiment, as illustrated in FIG. 5, the magnetic structure includes a metal tablet 112 and a magnetic tablet 220 which are magnetically attracted to each other, or two magnetically attracted magnets. Specifically, the fixing assembly 100 includes a metal tablet 112, a magnetic tablet 220, or a magnet, while the shower assembly 200 is provided corresponding to the fixing assembly 100, and is magnetically attracted to the fixing assembly 100. In detail, if the fixing assembly 100 includes a metal tablet 112, the shower assembly 200 includes a magnetic tablet 220; if the fixing assembly 100 includes a magnetic tablet 220, the shower assembly 200 includes a metal tablet 112; if the fixing assembly 100 includes a magnet, the shower assembly 200 includes another magnet that is attracted to the magnet of the fixing assembly. In this embodiment, specifically, the magnetic tablet 220 is fixed on a side of the global head seat 110 of the fixing assembly 100, which is close to the shower assembly 200. The metal tablet 112 is fixed on a side of the shower assembly 200, which is close to the global head seat 110, so as to further improve the stability of the shower head after fixing it with the clasp portion 210, which makes the shower head steadily move during adjusted. At the same time, a fixing cover 230 which is magnetic attraction penetrable seals and fixes the metal tablet 112 on the back of the shower assembly 200 to prevent the metal tablet 112 and the magnetic tablet 220 from direct contact for protecting the magnetic tablet 220.

In this embodiment, as shown in FIG. 3, the top spray support 300 includes a water catching pipe inside to be connected to the water pipe inside the wall. The top spray support 300 is installed on the wall first, and then the fixing assembly 100 is installed on the top spray support 300. Therefore, the fixing assembly 100 is installed on the wall to catch the water and thus be used.

In this embodiment, as shown in FIG. 3, the fixing holder 120 has a communicating hole 123 therein, wherein the communicating hole 123 has a first opening 1231 and a second opening 1232. The first opening 1231 is positioned at the junction of the fixing holder 120 and an end of the top spray support 300. Moreover, the first opening 1231 communicates with the water catching pipe of the top spray support 300, and the communicating hole 123 is hermetically connected to the water catching pipe. The second opening 1232 is positioned at the junction of the fixing holder 120 and a hose of the shower assembly 200, and the communicating hole 123 is hermetically connected to the hose. The water sequentially enters the top spray support 300, the communicating hole 123, the hose, and finally the shower assembly 200 to be sprayed from the shower head.

Figure 6:
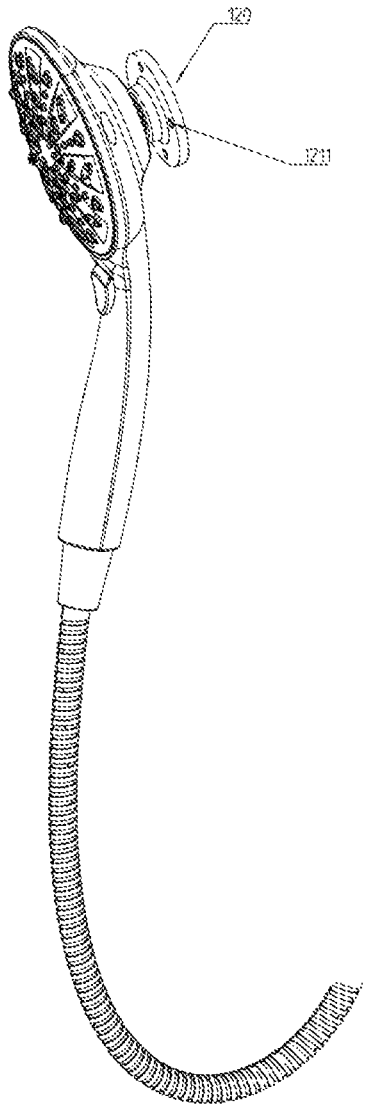
FIG. 6 is a perspective view of the shower head fixture of the second preferred embodiment of the present invention.
Figure 7:
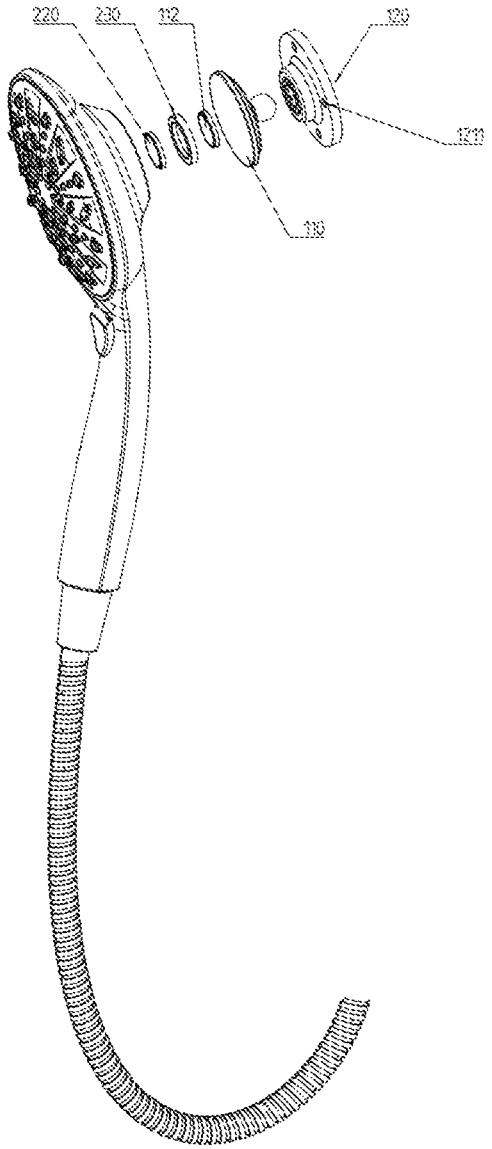
FIG. 7 an exploded view of the shower head fixture in FIG. 6.
Figure 8:
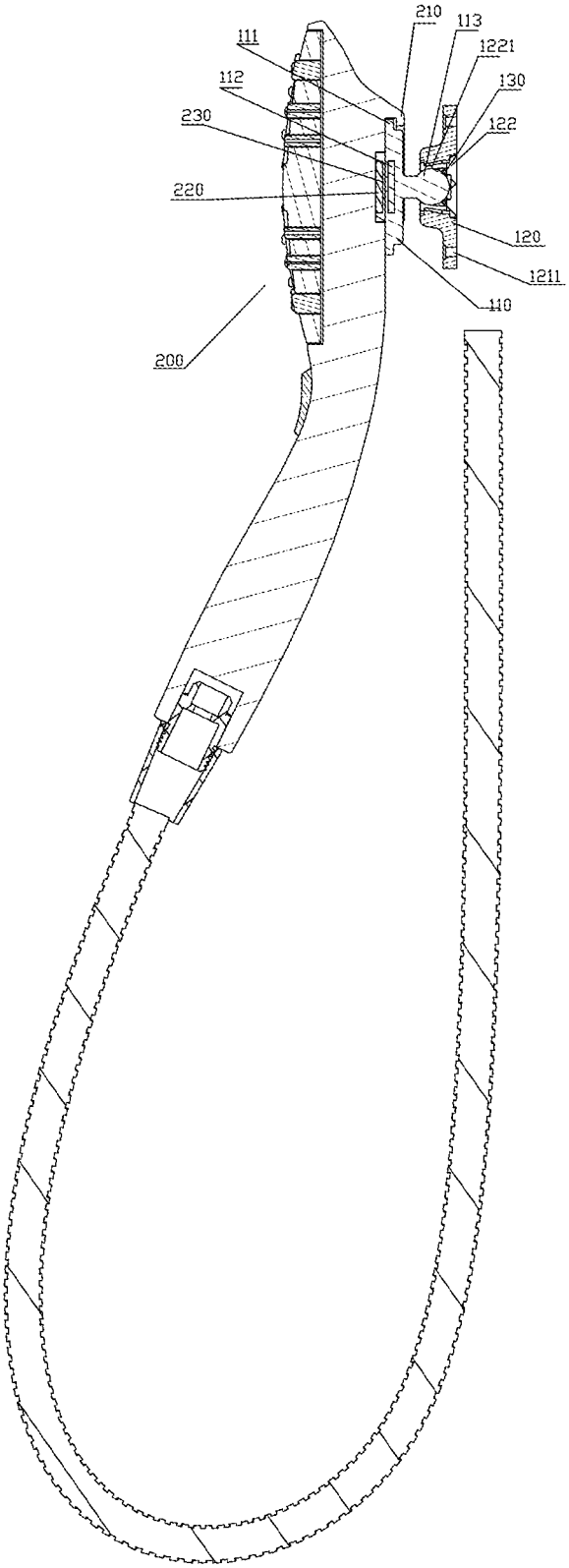
FIG. 8 is a sectional view of the shower head fixture in FIG. 6.

In the second embodiment as shown in FIG. 6 to FIG. 8, the fixing assembly 100 is fixedly installed on the wall, which is different from the first embodiment mentioned above. The fixing holder 120 has at least a screw hole 1211, and is fixed on the wall through a least an expansion screw. After installation, the first opening 1231 of the fixing holder 120 directly communicates the water pipe inside the wall so that the water can be sprayed by the shower head through the second opening 1232.

The embodiments described above are only preferred embodiments of the present invention. All equivalent structures which employ the concepts disclosed in this specification and the appended claims should fall within the scope of the present invention.

What is claimed is:

1. A shower head fixture comprising:

a fixing assembly comprising a global head seat and a fixing holder, wherein the global head seat is provided on the fixing holder through a global head connection mechanism; the global head seat has an embedded portion; and a shower assembly having a clasp portion, wherein the clasp portion and the embedded portion are fastened to each other, wherein a global head is provided on the global head seat, a locking chamber is provided in the fixing holder, the global head is movably provided in the locking chamber, and the global head seat is not for water to flow through.

2. The shower head fixture of claim 1, wherein the global head connection mechanism comprises the global head, the locking chamber, a locking member, and a friction member; the locking member and the friction member are both provided in the locking chamber; the global head is tightly locked by the locking member, which prevents the global head from falling off the locking chamber; the global head and friction member coordinate closely with friction.

3. The shower head fixture of claim 2, wherein the clasp portion is a semicircular clasp structure, and an insertion opening is provided at a bottom of the clasp portion; the embedded portion is a circular plate structure and is corresponding to the clasp portion; the embedded portion is inserted through the insertion opening to be embedded and clasped in the clasp portion.

4. The shower head fixture of claim 1, wherein the clasp portion is a semicircular clasp structure, and an insertion opening is provided at a bottom of the clasp portion; the embedded portion is a circular plate structure and is corresponding to the clasp portion; the embedded portion is inserted through the insertion opening to be embedded and clasped in the clasp portion.

5. The shower head fixture of claim 1, wherein the clasp portion is provided on a back of the shower assembly.

6. The shower head fixture of claim 5, further comprising a magnetic structure which is provided between the fixing assembly and the shower assembly to magnetically fix the fixing assembly and the shower assembly.

7. The shower head fixture of claim 6, wherein the magnetic structure comprises a magnetic tablet and a metal tablet which is magnetically attracted to the magnetic tablet, or two magnets magnetically attracted to each other; the fixing assembly comprises the metal tablet, the magnetic tablet, or the magnet, while the shower assembly is provided corresponding to the fixing assembly.

8. The shower head fixture of claim 7, wherein the magnetic tablet is fixed on a side of the global head seat of the fixing assembly, which is close to the shower assembly; the metal tablet is fixed on a side of the shower assembly, which is close to the global head seat.

9. The shower head fixture of claim 1, further comprising a top spray support installed on a wall, wherein the top spray support comprises a water catching pipe inside; the fixing holder is fixed on the wall or on the top spray support.

10. The shower head fixture of claim 9, wherein the fixing holder has a communicating hole therein; the communicating hole has a first opening and a second opening; the first opening is positioned at a junction of the fixing holder and an end of the top spray support, and communicates with the water catching pipe of the top spray support, and the communicating hole hermetically connected to the water catching pipe; the second opening is positioned at a junction of the fixing holder and a hose of the shower assembly, and the communicating hole is hermetically connected to the hose; the water sequentially enters the top spray support, the communicating hole, the hose, and finally the shower assembly.

* * * * *